US005269330A

United States Patent [19]

Hayes

[11] Patent Number: 5,269,330

[45] Date of Patent: Dec. 14, 1993

[54] POLISH PRINTING PROCESS

[76] Inventor: DeeAnn Hayes, 4134 N. Beltline #132, Irving, Tex. 75038

[21] Appl. No.: 939,915

[22] Filed: Sep. 3, 1992

[51] Int. Cl.[5] ..... A45D 24/00

[52] U.S. Cl. ..... 132/200; 132/73; 132/73.5

[58] Field of Search ..... 132/73, 73.5, 200, 285, 132/319, 320

[56] References Cited

U.S. PATENT DOCUMENTS

| | | | |
|---|---|---|---|
| 2,162,155 | 6/1939 | Calvin | 132/73 |
| 2,199,207 | 4/1940 | Nolan | 132/73 |
| 2,234,657 | 3/1941 | Smaldone | 132/285 |
| 2,864,384 | 12/1958 | Walter | 132/73 |
| 3,598,685 | 8/1971 | Lee et al. | 132/73 |
| 3,736,946 | 6/1973 | Yando et al. | 132/73 |
| 3,885,578 | 5/1975 | Hicks | 132/73 |
| 3,898,357 | 8/1975 | Miller et al. | 132/73 |
| 4,383,539 | 5/1983 | Collins et al. | 132/333 |
| 5,133,369 | 7/1992 | Billings | 132/200 |

*Primary Examiner*—Gene Mancene
*Assistant Examiner*—Frank A. LaViola

[57] ABSTRACT

The method herein describes a process of creating an inlayed design in wet nails. The purpose for this process is decorating finger, toe and acrylic nails. Preferably the utility kit for this process will include one base handle and at least one implement design tip. After applying acrylic or three coats of colored polish, the implement design tip is pressed into wet nail surface, allow to dry, and protected by covering with clear top coat. The implanted design will remain until next manicure.

4 Claims, 5 Drawing Sheets

POLISH PRINTING PROCESS

BACKGROUND OF INVENTION

Technical field of the Invention

The invention relates to cosmetology, more specifically, the present invention relates to a process, using an implement kit to decorate polished and acrylic nails.

It should be noted that, with polished nails, the options are two-toned and layered. Most women, unless in their teens, find these styles too ornamental for everyday wear. The other alternative is overlays. These stick-on made of thin metal, beaded studs and stickers have no present solution for falling off or peeling.

Whatever the precise merits, features and advantages of the above cited references, none of them fulfill or provide a novice, practical process for decorating polished and acrylic nails.

OBJECTS OF THE INVENTION

It is an object of the present invention to provide a method of creating various artistic designs into polished nails using an implement design tip to inlay a desired design into semi-dry polished nails.

Another object of the invention is to provide a method of creating various artistic designs into and through acrylic nails using an implement design tip to inlay and penetrate a desired design into semi-cured acrylic nails.

SUMMARY OF THE INVENTION

The method of the present invention consists of creating nail art to polished and acrylic nails using an implement design tip that penetrates polish and acrylic which has been applied to nails in standard fashion.

The foregoing objects are accomplished by polishing nails with acrylic or three coats of colored polish. Allowing the acrylic or polish to begin hardening. Press an implement into semi-dry nail surface, carefully lift implement from nail coating to allow design imprint to remain. After nail has completely dried, top coat with clear polish and let harden. The imprint design will remain until next manicure.

This invention is not designed for the forming of the acrylic nail but for the enhancement of acrylic nails that have been formed in standard fashion and have not yet cured. Acrylic nail designs will be made after the nail has already been formed and acrylic has begun to cure. Design tip is pressed into semi-dry nail. The implement tip will completely penetrate acrylic, thus leaving a hole in acrylic surface, afterwards, color and clear polish are applied in standard fashion.

Accordingly, the present invention describes a process of making designs implanted in polished or acrylic nails. The printing utility kit consists of, at least, one base handle and/or an implement tip which is fabricated into a desired design. The tips being of universal size at the connecting base, are interchangeable, so as to fit onto the base handle. The same tips can be used for acrylic or polished nails.

The various features of the invention are described out with particularity in the claims annexed to and forming a part of this disclosure. For a better understanding of the present invention reference can be made to the accompanying drawings and descriptive matter in which there are illustrated and described the preferred embodiments of the invention.

DESCRIPTION OF DRAWINGS

FIG. 1*a*–1*d* shows one of each tip style: 1*a*) rod/pin-stripler, 1*b*) cut-out 1*c*) roller and 1*d*) brand.

DESCRIPTION OF PREFERRED EMBODIMENT

Figure 1:
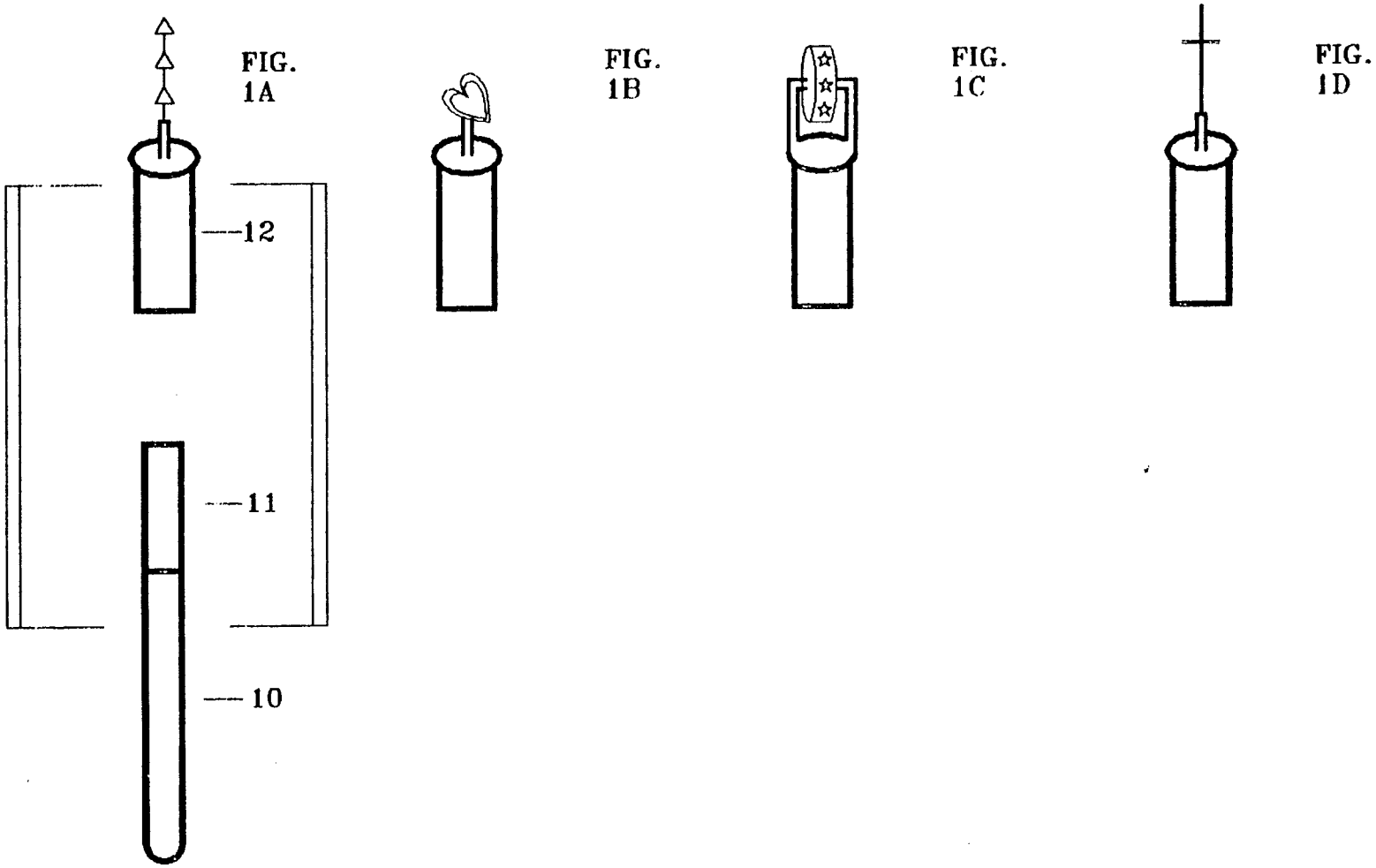
FIG. 1 illustrates polish printing kit: Including base handle and one of four different types of implement tip styles.
Figure 2D:
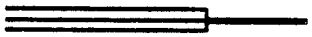
FIG. 2*a*–2*h* shows design examples created by the rod press.
Figure 2C:
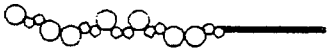
Figure 2B:
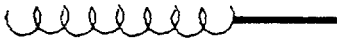
Figure 2A:
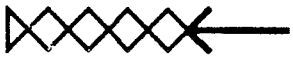
Figure 2H:
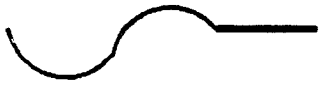
Figure 2G:
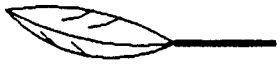
Figure 2F:
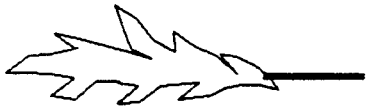
Figure 2E:
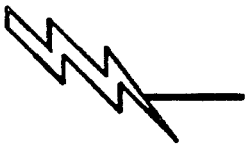
Figure 3:
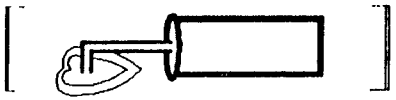
FIG. 3 shows side view of cut-out or cookie-cutter press.
Figure 3A:
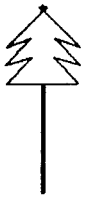
FIG. 3*a*–3*h* shows design examples created by the cut-out.
Figure 3B:
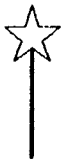
Figure 3C:
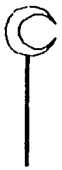
Figure 3D:
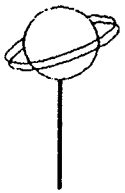
Figure 3E:
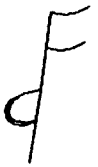
Figure 3F:
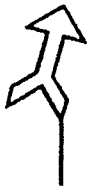
Figure 3G:
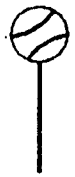
Figure 3H:
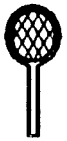
Figure 4D:
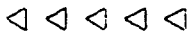
FIG. 4*a*–4*h* shows design examples created by the roller.
Figure 4C:
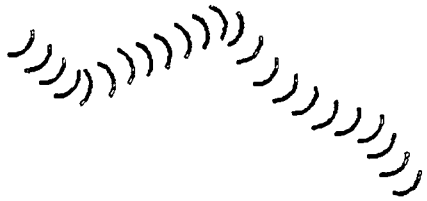
Figure 4B:
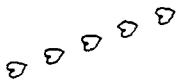
Figure 4A:
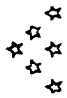
Figure 4H:
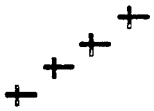
Figure 4G:
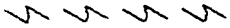
Figure 4F:
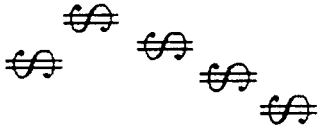
Figure 4E:
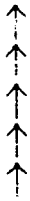
Figure 5A:
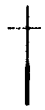
FIG. 5*a*–5*h* shows design examples created by the brand press.
Figure 5B:
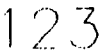
Figure 5C:
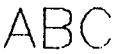
Figure 5D:
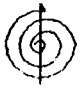
Figure 5E:
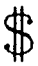
Figure 5F:
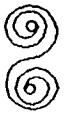
Figure 5G:
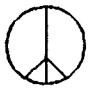
Figure 5H:
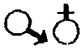

Referring to FIG. 1 the handle 10 is 5" to 7" in length and manufactured of plastic, metal and, the most popular, wood. Enclosing the blunt end of the handle is a 1" in length metal cap 11 used to insert and attach to base of implement design tip portion of invention. The sleeve portion of design tip 12 is also 1" in length metal and is the encasement into which the base handle is connected. The actual design portion of the kit, utilizing four basic types of tips including A) rod 1*a*, B) cut-out 1*b*, C) roller 1*c* and D) brand press 1*d* are made of medium weight wire and metal which will make the inlayed design in acrylic or polished nails that are not yet hardened. After polishing the nail with colored polish the design tip is pressed into semi-dry nail polish, lift carefully leaving artistic design in polish. Allow nail to continue to dry then top coat with clear polish. Design is permanent until next polish change.

Having already described polish process the acrylic process is almost the same, however, the difference being, the design tip will completely penetrate not yet cured acrylic thus making a hole cut-out design in uncured acrylic which will remain until next fill-in.

I claim as my invention:

1. A method of creating an inlayed design in nail polish comprising the steps of:

polishing at least one fingernail with three coats of colored polish;

allowing said polish to partially dry and pressing a design tip into said partially dry polish, said design tip being made of a wire and metal material which creates a decorative inlay in said nail polish coat;

lifting carefully said design tip from said partially dry polish and allowing a design formed by said design tip to dry.

2. The method of claim 1, further including the step of:

applying a top coat of clear nail polish, wherein said colored nail polish coat has a decorative design therein and is protected by said top coat of clear nail polish until a next polish change.

3. A method of creating an inlayed design in acrylic nails comprising the steps of:

forming an acrylic nail on at least one fingernail;

allowing the acrylic to partially cure and pressing a design tip into said partially cured acrylic, said design tip being made of a wire and metal material which creates a decorative cut-out design in said acrylic nail;

lifting carefully said design tip from said partially cured acrylic and allowing a design formed by said design tip to dry.

4. The method of claim 3, further including the step of:

applying a colored and/or clear polish to said acrylic nail, wherein said acrylic nail has a decorative design therein and is protected by said colored and/or clear polish until a next acrylic fill-in.

* * * * *